US006550107B1

(12) United States Patent
Jourde et al.

(10) Patent No.: US 6,550,107 B1
(45) Date of Patent: Apr. 22, 2003

(54) DISTRIBUTOR LAYER

(75) Inventors: Bernard Jourde, Elbeuf (FR); Christophe Clement, Saint Aubin les Elbeuf (FR); Bernard Chatelet, Elbeuf (FR)

(73) Assignee: Asselin, Elbeuf (FR)

( * ) Notice: Subject to any disclaimer, the term of this patent is extended or adjusted under 35 U.S.C. 154(b) by 0 days.

(21) Appl. No.: 09/937,348

(22) PCT Filed: Mar. 21, 2000

(86) PCT No.: PCT/FR00/00698

§ 371 (c)(1),
(2), (4) Date: Sep. 24, 2001

(87) PCT Pub. No.: WO00/56960

PCT Pub. Date: Sep. 28, 2000

(30) Foreign Application Priority Data

Mar. 23, 1999 (FR) ..... 9903562

(51) Int. Cl.[7] ..... D04H 11/00
(52) U.S. Cl. ..... 19/163; 19/161.1
(58) Field of Search ..... 19/65 A, 160, 19/161.1, 163, 296, 302; 270/39.01, 39.05, 40, 41

(56) References Cited

U.S. PATENT DOCUMENTS

| | | | | |
|---|---|---|---|---|
| 1,886,919 A | | 11/1932 | Sturgis | |
| 3,877,628 A | | 4/1975 | Asselin et al. | |
| 4,830,351 A | | 5/1989 | Stanislaw | |
| 4,944,502 A | | 7/1990 | Platzer et al. | |
| 5,285,554 A | * | 2/1994 | Jean et al. | 19/163 |
| 5,289,617 A | * | 3/1994 | Jean et al. | 19/163 |
| 5,341,543 A | * | 8/1994 | Jean et al. | 19/161.1 |
| 5,373,610 A | * | 12/1994 | Jean et al. | 19/163 |
| 5,400,475 A | | 3/1995 | Hille | |
| 6,050,469 A | | 4/2000 | Brabant et al. | |

FOREIGN PATENT DOCUMENTS

| | | |
|---|---|---|
| DE | 295 18 587 U1 | 1/1996 |
| EP | 0 315 930 B1 | 5/1993 |
| EP | 0 609 907 A2 | 8/1994 |
| EP | 0 517 563 B1 | 10/1995 |
| EP | 0 733 729 A1 | 9/1996 |
| EP | 0865521 B1 | 9/1999 |
| FR | 73 22277 | 1/1976 |
| FR | 2553102 | 4/1985 |
| WO | 97/19209 | 5/1997 |

* cited by examiner

*Primary Examiner*—Gary L Welch
(74) *Attorney, Agent, or Firm*—Young & Thompson

(57) ABSTRACT

A distributor layer moving in a reciprocating motion to deposit a web coming from a card, on an output apron to form thereon a lap designed for subsequent mechanical bonding. A front conveyor belt transporting the web up to a folding carriage and a rear conveyor belt for supporting the other surface of the web up to a depositor carriage are driven so as to have identical moving speeds in a pinching zone. In the folding carriage the web is deviated by less than 90 degrees to move in a down slope along a section, then a turning of more than 90 degrees, is first exposed, then is externally supported by a support structure. The pinching zone slopes slightly downwards. The web is likewise exposed for the turning in the folding carriage then with external support by an arrangement in a second angular surface.

27 Claims, 6 Drawing Sheets

DISTRIBUTOR LAYER

BACKGROUND OF THE INVENTION

The present invention concerns a crosslapper for transforming a web into a fleece by folding.

Such machines are known, in which a web of fibres, coming for example from a card, is first of all transported by a first conveyor belt, called a front conveyor belt, to a pinching zone where it is held between the conveyor belt and a second conveyor belt—or rear conveyor belt—which transport it to a lapping carriage.

The lapping carriage has a lapping slot facing downwards, through which the web is released whilst the lapping carriage reciprocates above an output apron. The web is thus accordion folded on the output apron. At the same time, the output apron moves substantially perpendicularly to the direction in which the front and back conveyor belts are moving. Thus, instead of being exactly piled on one another, the successive segments of web between two folds are offset in a zigzag pattern along the output apron. The continuous fleece thus formed is to undergo a bonding and/or compaction treatment, consisting for example in needling.

The transport path of the web in the crosslapper also passes through a reciprocable storage carriage to regulate the length of the path between the entry zone of the web into the crosslapper and the lapping slot, and thus regulate the speed at which the web is fed through the lapping slot.

The web, essentially made up of longitudinal fibers that are very loosely connected and together form a highly aerated structure, has a very low mechanical strength. However, it is necessary that during passage through the crosslapper, the web maintains its initial dimensions as much as possible, that is in particular its initial width and the uniform distribution of its weight over the width. However, manipulations undergone by the web in the crosslapper endanger this desired stability.

In the past, many machines were used to try to remedy this difficulty by increasing the length of the pinching zone. This often led to the creation of an additional turn in the path of the web in the middle of the pinching zone, see in particular FR-B-2 553 102, or even to placing the storage carriage in the middle of the pinching zone, see in particular FR-A-2 234 395. This was intended to remedy defects found on even older machines such as those described according to U.S. Pat. No. 1,886,919 where 180° turns of the web were carried out whilst the web was exposed on the outside of the turn, with many disadvantages related to the centrifugal force and major differences in performance according to the direction of movement of the carriage where the turn was made.

By comparison with this old prior art (U.S. Pat. No. 1,886,919; FRB 2 234 395, FR-B-2 553 102), EP-A-0 517 563 made possible a spectacular increase in speeds of industrial treatment of the web by showing how to combine a substantially rectilinear pinching zone extending from one carriage to the other, with exposed transportation upstream from the storage carriage, and a two-part turn in the storage carriage including a first turn making the web pass from a horizontal path to a sloping path, then a second turn at an angle greater than 90° and less than 180° with a first pinching line for the web between the two conveyor belts in an intermediate angular position of this second turn.

This structure made it possible to almost double the industrial travelling speed of the web in the crosslapper, which thus increased from approximately 80 m/min to approx. 150 m/min.

A phenomenon observed according to the invention when it was attempted to exceed this speed with a structure according to EP-A-0 517 563 is that the pinching line located in an intermediate position on the second partial turn of the storage carriage tends to expell the air from the web in an upstream direction. The result is a swelling and deformation of the web upstream of the pinching line, then a radial expansion of the web when the web passes through the pinching line.

WO-A-97/19 209 shows how to create a first pinching zone with a slightly convergent shape along the oblique descending part between the two partial turns in the storage carriage, then to arrange several pinching lines along the whole of the second partial turn, with a first pinching line just upstream and a last pinching line just downstream of the turn.

In practice, this complex solution does not bring any improvement since it multiplies the compression-decompression cycles to which the web is subjected in the turn.

Moreover, it has also been found according to the invention that the search for increased speeds was also tending to lead to a problem of web deformation in the. lapping carriage during recompression of the web in the lapping slot. WO-A-97/19 209 does not propose any solution applicable to the lapping carriage.

SUMMARY OF THE INVENTION

The object of the invention is thus to propose a crossslapper for guiding the web through at least one turn, made up of a structure allowing to increase the travelling speed of the web in the crosslapper without leading to unacceptable deformation of the web.

According to the invention, the crosslapper including:

- at least two endless conveyor belts that together define, for a fibre web, a transport path extending from an entry zone to a lapping slot;
- at least one lapping carriage having guiding rollers for the two conveyor belts and on which the lapping slot is formed;
- an output apron which is movable under the lapping slot substantially parallel to the axes of the guide rollers,
  - the path forming at least one turn against the outer surface of one of the conveyor belts in a zone where the inner surface of this conveyor belt rests on an internal guide roller, the web being exposed on an initial angular area of the turn, then being restricted radially outwards by a support zone belonging to the other conveyor belt within a second, angular area of the turn,
  - is characterised in that the support zone is guided according to a curvature ranging from convex with a radius greater than the inner guide roller, to concave substantially following the outer circumference of the web.

According to the invention it was found that is was advantageous:

- on one hand to keep the exposed condition along a beginning of the turn, in said first angular area, along which the web is more or less supported by its own weight and by a certain tendency to adhere to the internal conveyor belt; and
- on the other hand to transform the pinching line of the prior art into a distributed support structure that may consist of a flat section of the external conveyor belt, of a section of the external conveyor belt supported by a large diameter external roller, or even by a simulated section with inverted curvature, hence concave on the web side, by means of a succession of at least two external rollers along the second angular area of the turn.

In the storage carriage, the version where the support zone comprises a flat section of the external conveyor belt has turned out to be especially advantageous. Such a support structure behaves like an active deflector, which drives the web into the second part of the turn around the internal roller, in a continuous way over quite a large second angular area. By comparison with the pinching line of EP-A-0 517 563, the flat section channels and propels the web into its turn much earlier, whilst supporting it further downstream towards the longitudinal section of the pinching zone. In this respect, it is particularly advantageous for the external surface of the flat section, which is the one that is active in terms of textiles, to face obliquely upwards.

It is also advantageous in the storage carriage that the web is free of any support upstream of the second angular area and in particular along the downwardly sloping section between the two partial turns.

It is also advantageous, in the storage carriage, that downstream of the second angular area, the web runs through a third angular area free of external support until the web is supported by the longitudinal section of the external conveyor belt extending into the pinching zone. The longitudinal section of the external conveyor belt is preferably supported by a roller placed a little behind the internal roller in relation to the direction of movement of the web, so as not to form a rigid pinching line at the turn exit, contrary to what is recommended by WO-97/19209.

According to another feature of the invention with its own specific interest, the pinching zone extends in a rectilinear direction in a slightly descending slope from the storage carriage to the lapping carriage. The advantage of this slope is slightly to reduce the turn to be made in the storage carriage and to reduce accordingly the turn to be made in the lapping carriage. Given that the horizontal distance between the lapping carriage and the storage carriage varies in operation, the slope of the pinching zone is not constant. Typically it may be of the order of a few degrees.

Up to now it was normal to make the transportation path in the form of horizontal segments separated by turns at 180°. This was a disadvantage of the old machines, as described in EP-A-0 315 930, where the lapping carriage had at all times a speed double that of the storage carriage, so that each movement of the lapping carriage was precisely compensated for by a variation half as large of each of the two conveyor belt sections located on either side of the turn at 180° formed on the storage carriage. In modern crosslappers, such a constant coupling between the two carriages is eliminated, and each of the carriages is driven by its own programmable servomotor, and thus programming of the storage carriage makes it possible in addition to compensate for the "defect" caused by the not inconsiderable slope of the pinching zone.

To guide the web in the lapping carriage, it is proposed, in a non-limitative fashion according to the invention, that the outer surface of the outer conveyor belt should face obliquely downwards in the neck area formed with the outer surface of the internal conveyor belt. So, starting from the neck zone forming the lapping slot, the web may be deposited on one side or the other according to the direction of movement of the lapping carriage.

It is also advantageous in the lapping carriage, for the first angular area to be preceded by a preparatory zone where the web rests exposed on the internal conveyor belt located below, and, immediately upstream, by a zone where the web is covered by the external conveyor belt located above, in particular in the pinching zone, which external conveyor belt comes away from the web obliquely upwards in the preparatory zone. It has in fact been observed that at the exit of the pinching zone, the web was tending to stick to the upper conveyor belt and hence form a sort of wave above the conveyor belt located below. As a result of the layout that has just been described, the upper conveyor belt moves relatively abruptly apart from the web. This tends to reduce the effect of adherence and in addition the preparatory zone leaves time for the web to fall back on to the underlying conveyor belt before reaching the first angular area of the turn. This effect is improved even further as a result of the slight slope of the pinching zone that has been proposed above.

It is preferred according to the invention that the turning structure be applied to at least two turns in the crosslapper and in particular to a first turn in a storage carriage located at the entry to a pinching zone, then to a second turn located at the exit of the entirely rectilinear pinching zone in the lapping carriage. But the invention is also advantageous if only one turn is structured in accordance with the invention.

Other features and advantages of the invention will be apparent from the description below giving non-limitative examples.

In the attached drawings:

DETAILED DESCRIPTION OF THE PREFERRED EMBODIMENTS

Figure 1:
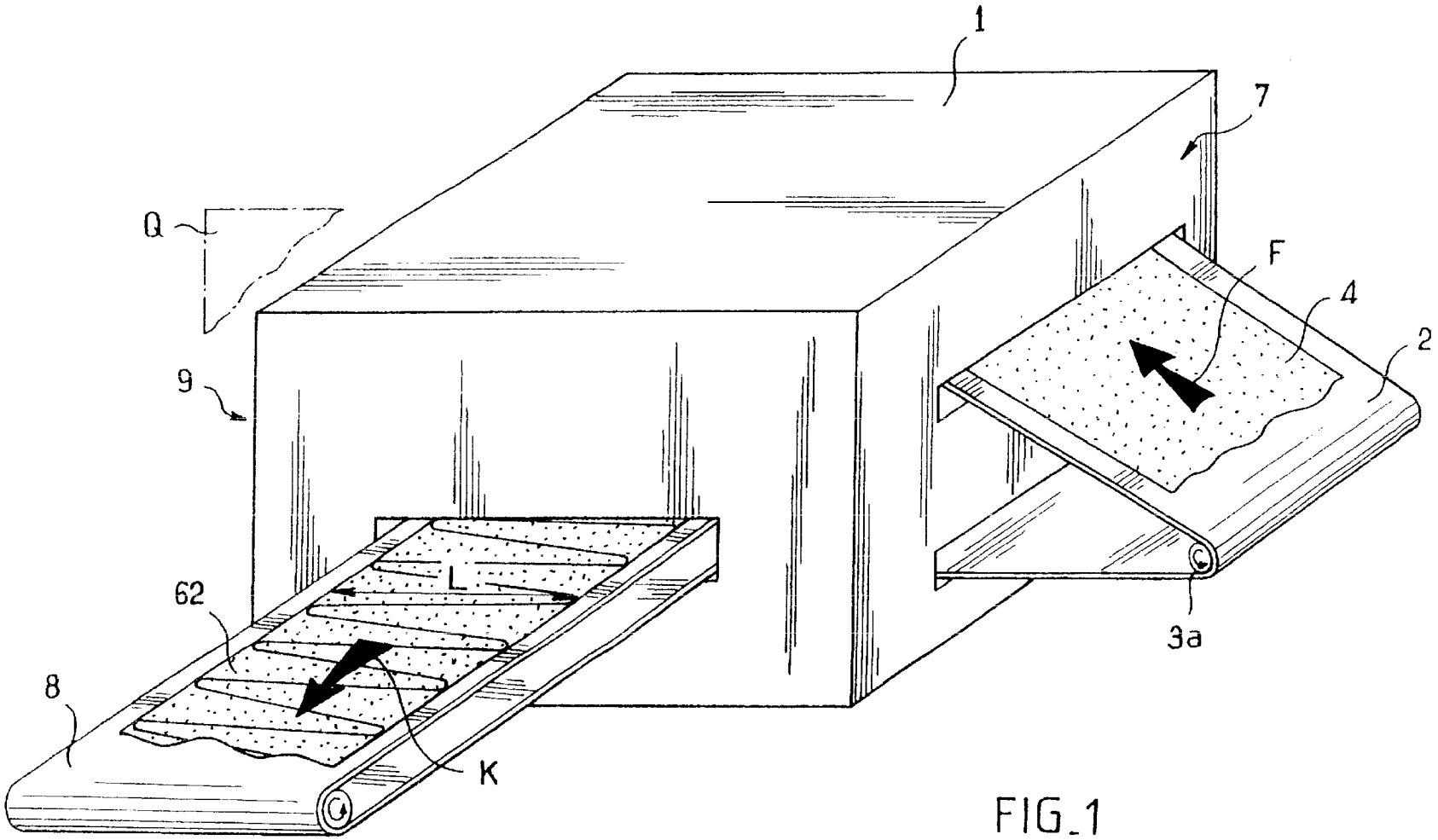
FIG 1 PRIOR ART
FIG. 1 is a very schematic external view of a crosslapper, in perspective.

The crosslapper represented in perspective in FIG. 1 includes a first conveyor belt 2, called "front conveyor belt", which collects the web of fibers 4, for example from a card not shown, and transports it into chamber 1 where it is transformed by folding into a fleece 62 transported by an output apron 8 outside chamber 1, typically to a needling machine, or other compaction and/or bonding machine, not shown. The directions of transportation of web 4 and of fleece 62 respectively are indicated in FIG. 1 by the arrows F and K. For reference purposes, side 7 of the crosslapper adjacent to the surface through which web 4 penetrates will be called "front part" and side 9 of the crosslapper opposite to the front part 7 will be called "rear part".

Figure 2:
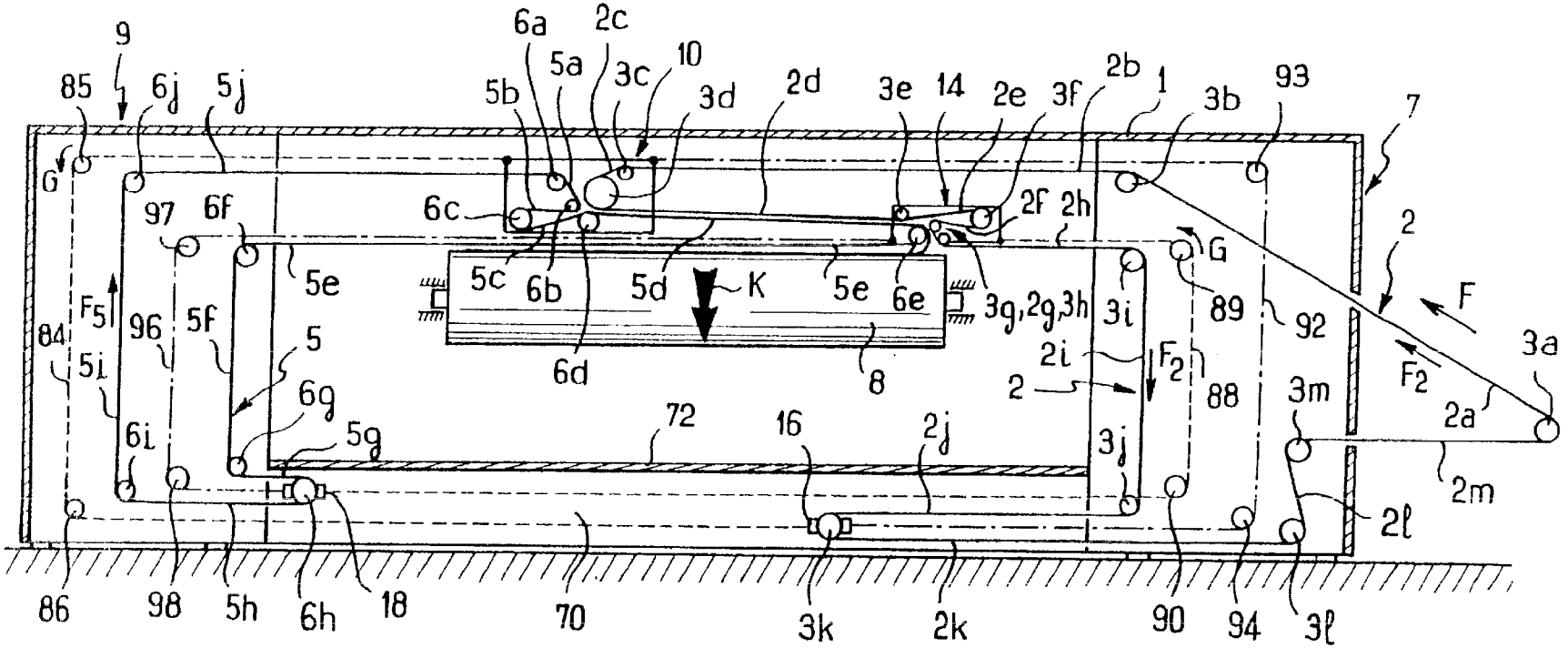
FIGS. 2 to 4 are schematic views in elevation of a crosslapper in accordance with the invention, in three different positions.
Figure 3:
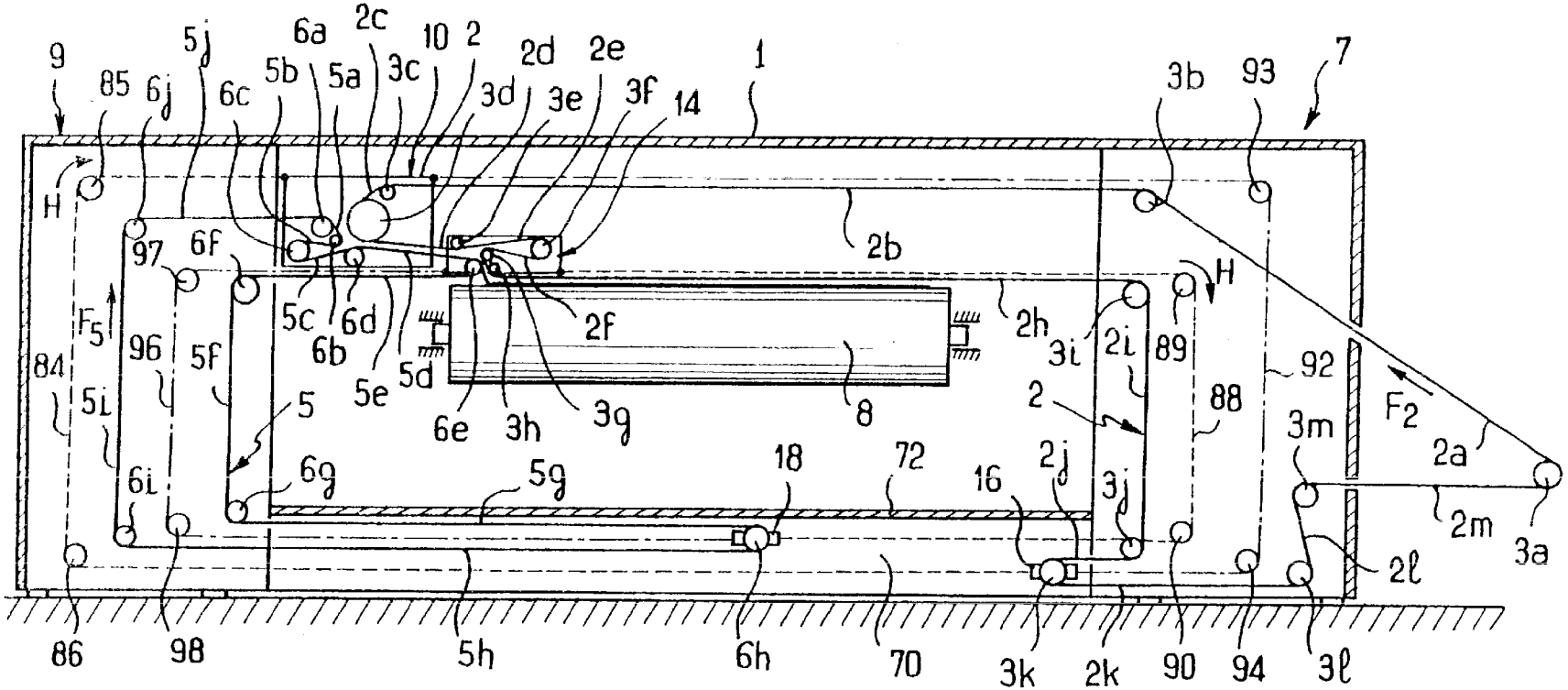
Figure 4:
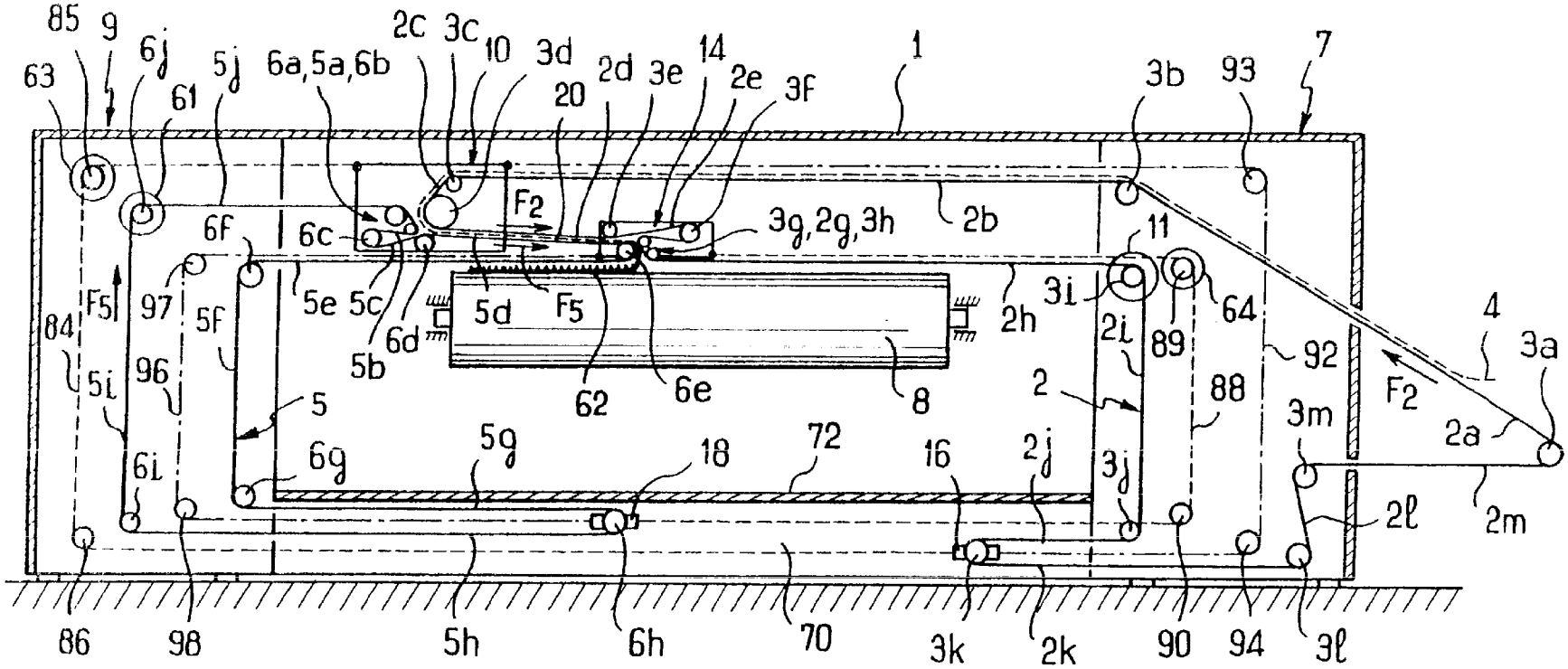

The interior of the crosslapper is represented schematically on the elevation views of FIGS. 2 to 4, taken along a plane Q (FIG. 1) perpendicular to the direction of transportation of fleece 62 by the output apron 8.

In association with front conveyor belt 2, the crosslapper includes a second conveyor belt 5, called "rear conveyor belt". Conveyor belts 2 and 5, represented by solid lines in FIGS. 2 to 4, have the same width and have their side edges in the same planes parallel to the plane of FIGS. 2 to 4. Front conveyor belt 2 follows a closed path comprising sections 2*a* to 2*m* delimited by cylindrical guide rollers 3*a* to 3*m*. The rear conveyor belt 5 follows a closed path comprising sections 5*a* to 5*j* delimited by cylindrical guide rollers 6*a* to 6*j*.

The guide rollers 3*a* to 3*m*, 6*a* to 6*j* are pivotally mounted around respective axes which are perpendicular to the plane of FIGS. 2 to 4, that is substantially parallel to the direction of movement of output apron 8. The axes of rollers 3*a*, 3*b*, 3*i*, 3*j*, 3*l*, 3*m*, and 6*f*, 6*g*, 6*i* and 6*j* are stationary in relation to the stationary chamber 1 of the crosslapper.

For each conveyor belt 2, 5, at least one of the rollers with a fixed axis (for example the rollers numbered respectively 3*i* and 6*j*) is rotated by a respective servomotor 11, 61 (FIG. 4) so as to cause the conveyor belts 2, 5 to travel along their closed paths respectively 2*a* to 2*m*, 5*a* to 5*j* according to predetermined kinematic laws that will be discussed later on. The travelling directions of conveyor belts 2, 5 are indicated in FIGS. 2 to 4 by the arrows F2, F5, respectively.

The axes of rollers 3*c*, 3*d* and 6*a*, 6*b*, 6*c*, 6*d* (see also FIG. 5) are carried by a first main movable carriage 10, called "storage carriage". The axes of rollers 3*e*, 3*f*, 3*g*, 3*h* and 6*e* (see also FIG. 6) are carried by a second main movable carriage 14, called "lapping carriage".

The main carriages 10, 14 are located above output apron 8 and are reciprocable along a translation line which is horizontal and perpendicular to the axes of rollers 3*a* to 3*m*, 6*a* to 6*j*.

In addition, each conveyor belt 2, 5 forms a turn at 180° around a respective guide roller 3*k*, 6*h* carried by a respective auxiliary carriage 16, 18. The two auxiliary carriages 16, 18 have movements which compensate those of the main carriages 10, 14 to keep the length of each of the closed paths 2*a* to 2*m*, 5*a* to 5*j* substantially constant.

The closed paths 2*a* to 2*m*, 5*a* to 5*j* are external from one another. In a pinching zone 20, the conveyor belt sections numbered 2*d* and 5*d* in FIGS. 2 to 6 are located closely parallel to one another so as to hold web 4 between them. Web 4 is represented by dotted lines in FIG. 4 but is not represented in FIGS. 2 and 3, for reasons of simplicity.

The neighbouring sections 2*d*, 5*d* of the closed paths followed by the two conveyor belts 2, 5 in pinching zone 20 are delimited, at the entry of the pinching zone, by guide rollers 3*d*, 6*d*, carried by the storage carriage 10 and, at the exit of pinching zone 20, by guide rollers 3*e*, 6*e*, carried by lapping carriage 14. The pinching zone thus extends in a straight line from the storage carriage 10 up to the lapping carriage 14.

According to a feature of the invention, the pinching zone 20 is in a slight slope, of a few degrees, oriented downwardly in relation to the direction in which the fibres move from the storage carriage towards the lapping carriage. Hereafter, the slightly sloping direction of the pinching zone will be called "longitudinal". This slope varies slightly according to the relative position of carriages 10 and 14, and it is greater when carriages 10 and 14 are near to one another (FIG. 3).

To guide front conveyor belt 2, the storage carriage 10 (see also the more detailed view in FIG. 5) has two guide rollers 3*c*, 3*d*, located inside the closed path 2*a* to 2*m*. Upstream from the storage carriage 10, the front conveyor belt 2 carries web 4 exposed along the substantially horizontal section 2*b* coming from the front part 7. On reaching the storage carriage 10, the front conveyor belt 2 makes an initial turn around the return roller 3*c* through an angle A included between 0 and 90 degrees to form the downwardly sloping section 2*c*, then a second turn around roller 3*d* through an angle B included between 90 and 180 degrees to form the longitudinal section 2*d* of pinching zone 20, directed towards front part 7 of the crosslapper. The total angular deviation A+B of front conveyor belt 2 around the guide rollers 3*c*, 3*d*, carried by the storage carriage 10 is equal to 180 degrees minus the slope of the pinching zone 20.

The storage carriage 10 also carries four guide rollers 6*a*, 6*b*, 6*c*, 6*d* bearing the rear conveyor belt 5, the rollers 6*a*, 6*b* and 6*d* being inside its closed path 5*a* to 5*j* and the roller 6*c*, with a larger radius called detour roller, being external to this closed path 5*a* to 5*j*. Upstream from storage carriage 10, the rear conveyor belt 5, which does not carry web 4, follows the substantially horizontal section 5*j* coming from the rear part 9. On reaching the storage carriage 10, the rear conveyor belt 5 makes an initial turn around the return roller 6*a* through an angle D included between 0 and 90 degrees, oriented downwards to enter within section 5*a*, a second turn of between 90 and 180 degrees around roller 6*b* to enter within section 5*b*, then a third turn around detour roller 6*c* through a negative angle (since the detour roller 6*c* is external to the closed path 5*a* to 5*j*) greater than 180 degrees, and finally a fourth turn around roller 6*d* to enter the longitudinal section 5*d* of pinching zone 20, directed towards the front part 7 of the crosslapper. The total angular deviation of rear conveyor belt 5 around guide rollers 6*a*, 6*b*, 6*c*, 6*d* carried by the storage carriage 10 is equal to the slope of the pinching zone 20.

A description will now be given of the general operation of the crosslapper.

In the example given, the rollers 3*i*, 6*j* have been chosen as drive rollers since their speed of rotation directly defines the speed of sections 2*d* and 5*d* of the conveyor belts in the pinching zone 20. It is arranged for the speed of sections 2*d* and 5*d* to be equal so that the web 4 held between sections 2*d* and 5*d* is itself driven en bloc at this speed, without undergoing any rubbing or shear effect between its lower surface and its upper surface. Therefore, with the choice of rollers 3*i* and 6*j* as drive rollers, the two motors are driven so that they both always turn, at the same speed if rollers 3*i* and 6*j* have the same diameter.

At the same time, the lapping carriage 14 is reciprocally actuated along the horizontal direction which is perpendicular to the axes of the rollers above output apron 8, so as to deposit the web 4 on output apron 8 to form lap 62 as mentioned with reference to FIG. 1. If it is desired that the web be deposited without compression or extension, it is necessary for the speed of the web flowing downwards through the lapping slot 38 (FIG. 6) formed between the rear conveyor belt 5 around the roller 6*e* and section 2*g* of conveyor belt 2, to be equal to the speed of movement of the lapping carriage 14. When the lapping carriage 14 moves towards the front part 7 of the crosslapper (situation shown in FIG. 4), this means that the travelling speed of the conveyor belts in the pinching zone 20 is substantially double that of the lapping carriage 14. For the other direction of movement of lapping carriage 14, the absence of compression or extension of the web takes place when the speed of movement of sections 2*d* and 5*d* is substantially zero. Hence, the speed of sections 2*d* and 5*d* considerably varies during operation. The storage carriage 10 is reciprocally actuated so as to transform the highly variable speed of section 2*d* into a generally constant speed for sections 2*b* and 2*a*, corresponding to the generally constant speed at which web 4 is delivered by the card.

It is also possible to deposit web 4 using compression or extension on output apron 8 by controlling a speed ratio different from 1 between the speed of movement of lapping carriage 14 and the speed at which conveyor belts 2 and 5 move the web through the lapping slot 38.

The principles governing the speeds in a crosslapper are described in FR-A-2 234 395 and EP-A-0 315 930.

The front conveyor belt 2 forms a loop above conveyor belt 8, between the stationary rollers 3*b* and 3*i*. The length of such loop is variable since it depends on the position of the storage carriage, 10 along its reciprocating stroke. The front conveyor belt 2 is unstretchable and this length variation is compensated for by a contrary variation of another loop formed beneath output apron 8 between the two stationary rollers 3*j* and 3*l* by reciprocal movement of the auxiliary carriage 16, bearing roller 3*k* around which conveyor belt 2 makes a turn of 180°. Likewise, rear conveyor belt 5 forms a loop between the stationary rollers 6*j* and 6*f* above output apron 8, and the length of such loop varies according to the position of lapping carriage 14 along its reciprocating stroke. Rear conveyor belt 5 is unstretchable and the variation in length of this loop is compensated for by a contrary variation of another loop formed by sections 5*g*, 5*h* between rollers 6*g* and 6*i*, under output apron 8, by reciprocal movement of the auxiliary carriage 18, bearing roller 6*h* around which rear conveyor belt 2 makes a turn of 180°.

To drive the main carriages 10, 14 and auxiliary carriages 16, 18, the crosslapper has two driving pinions 85, 89 driven by respective servomotors 63, 64 (FIG. 4) and meshing respectively with toothed drive belts 84, 88 symbolically represented as dashed lines. Belt 84 is secured at one end to the storage carriage 10 and at the other end to auxiliary carriage 16. Toothed drive belt 84 goes round drive pinion 85 and a return pinion 86 both mounted in a fixed position in the rear part 9 of the crosslapper. Pinions 85 and 86 are arranged so that the end sections of the toothed drive belt 84 are parallel to the direction of movement of carriages 10 and 16. Likewise, a toothed drive belt 88 has one end secured to lapping carriage 14 and its other end secured to the auxiliary carriage 18. Toothed drive belt 88 goes round the drive pinion 89 and the return pinion 90 both securely mounted in the front part 7. Pinions 89 and 90 are arranged so that the end sections of toothed drive belt 88 are parallel to the direction of movement of carriages 14 and 18.

In addition, storage carriage 10 is coupled to auxiliary carriage 16 by a cable 92, represented in dash-dotted lines, which goes round two return pulleys 93 and 94 mounted in a stationary position in the front part 7. Lapping carriage 14 and auxiliary carriage 18 are coupled by a cable 96 going around two return pulleys 97 and 98 mounted in a stationary position in the rear part 9. The end sections of these two cables are parallel to the direction of movement of the four carriages 10, 14, 16, 18. When the storage carriage 10 moves towards the rear part 9, it is directly drawn by toothed drive belt 84 and it draws the auxiliary carriage 16 by means of cable 92. In the other direction of movement, it is the auxiliary carriage 16 which is drawn by toothed drive belt 84 and which in its turn draws the storage carriage 10 by means of cable 92. When the lapping carriage 14 moves towards the front part 7 it is drawn by toothed drive belt 88 and it draws auxiliary carriage 18 by means of cable 96. In the other direction of movement of lapping carriage 14, the toothed drive belt 88 draws the auxiliary carriage 18 which in its turn draws the lapping carriage 14 by means of cable 96. The auxiliary carriages 16 and 18 are installed in a tunnel 70 formed under a partition 72 extending underneath output apron 8. The partition 72 screens web 4 and the formed fleece 62 from air turbulence caused by the movement of auxiliary carriages 16 and 18.

In a way that is not shown, carriages 10, 14, 16 and 18 are guided for example into rails fixed within the chamber 1 laterally on each side of conveyor belts 2 and 5. Each cable 92 or 96 and each toothed drive belt 84 or 88 is preferably constructed in practice in the form of two cables or respectively belts mounted in parallel laterally on either side of conveyor belts 2 and 5.

The slope of pinching zone 2*d*, 5*d* is sufficiently slight for the variation in length of sections 2*d* and 5*d* to be substantially equal to the variation in horizontal distance between carriages 10 and 14 during operation. Thus, the direct coupling that has been described for carriages 16 and 18 with the storage carriage 10 and lapping carriage 14 respectively does not cause a significant stress in conveyor belts 2 and 5. In particular, if it is desired to avoid any residual stress in the conveyor belts and/or to increase the slope of the pinching zone 2*d*, 5*d*, the mechanical coupling between each of the storage carriage 10 and lapping carriage 14 and the respective auxiliary carriage 16 or 18 may be eliminated, and each carriage may be driven using a servomotor specific to this carriage. Thus, the auxiliary carriages 16 and 18 may be given a speed with a law slightly different from that of the associated main carriage 10 or 14. It is also possible to shift rollers 6*i* and 3*l* vertically so that sections 5*h* and 2*k* have a slight slope, in order for the length compensation loops 5*g*, 5*h*, 2*j*, 2*k* to have a geometry with length variations which more exactly compensate for the variations in length of the conveyor belts above the output apron 8.

As shown in FIG. 4, web 4 arriving from the card is deposited on the ascending section 2*a* forming an entry zone in the crosslapper. Web 4 is transported exposed on the ascending slope section 2*a* and then on the horizontal section 2*b* and on the descending slope section 2*c* as well as into a first angular area $B_1$ of the rotation through angle B around roller 3*d* which is inside this turn. The front conveyor belt 2 thus forms the internal conveyor belt for this turn, in relation to web 4.

Section 2*c*, by its descending slope, constitutes a preparatory section to the turn around the inner roller 3*d*, during which turn the support of the weight of the web will be transferred from the internal conveyor belt (front conveyor belt 2) to the external conveyor belt (rear conveyor belt 5). On section 2*c*, the web may fall back flat on to the conveyor belt 2 even if it has slightly taken off during turning around roller 3*c* through angle A.

Figure 5:
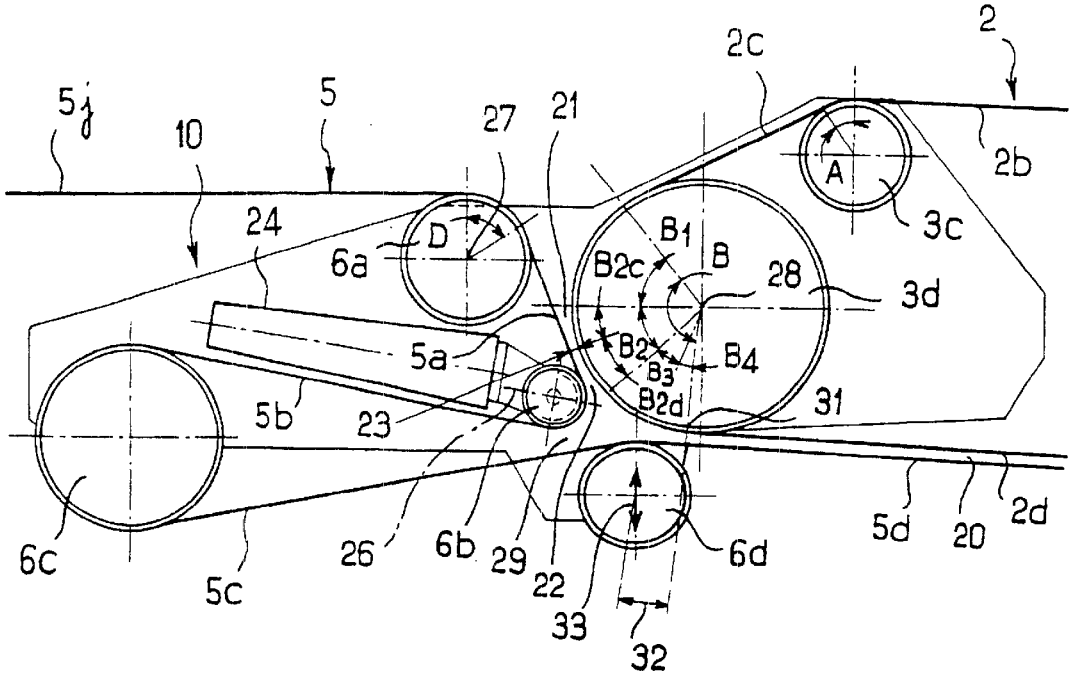
FIG. 5 is an elevational view on a larger scale representing the storage carriage of the crosslapper of FIGS. 2 to 4, in more detail.

In the representation of FIG. 5, the angular area B1 terminates at the point where the web moves vertically. In reality, this limit is vague and depends in particular on the thickness of the web as well as on its weight and on the speed of operation of the machine. In a second angular area B2 of the turn around the internal roller 3*d*, the web is supported on the radially external side by the flat section 5*a* of the rear conveyor belt 5, hence by a region with infinite curvature radius, of conveyor belt 5. Through the angular area $B_2$, the front conveyor belt 2 forms with the rear conveyor belt 5 a converging section covering the angular area $B_{2c}$, followed by a diverging section 22 covering an angular area $B_{2d}$, the angular areas $B_{2c}$, and $B_{2d}$ together forming the angular area $B_2$. The converging section 21 and the diverging section 22 are connected to one another by a neck 23 where the space made for the web is small but not non-existent even when the machine is at rest, in the absence of the web, as represented in FIG. 5. The converging section 21 and the neck 23 as well as the first part of the diverging section 22 are adjacent to the flat section 5*a* of rear conveyor belt 5. The end part of the diverging section 22 corresponds to the first part of the rotation of the rear conveyor belt 5 around roller 6*b*.

Section 5*a* is oriented so that its external surface, in contact with the web, supports the web from below in the angular area B2, where the conjugated effect of the centrifugal force and of the weight of the web tends to dislodge the latter from the front conveyor belt 2. In the example given, section 5*a* is inclined by about 30 degrees in relation to the vertical. Thus, in relation to axis 28 of internal roller 3*d*, the neck 23 is located at approximately 30 degrees below the horizontal diameter of roller 3*d*. Section 5*a* is substantially perpendicular to the sloping section 2*c* of front conveyor belt 2.

It should be noted that the internal roller 3*d* has a relatively large diameter, for example included between 20 and 25 centimetres. This results in the following advantages:

- for a given travelling speed of the web, the larger the radius of the turn, the lower the centrifugal force undergone by the web in the turn;
- the relatively large diameter of the internal roller 3*d* makes it practically easier to achieve relatively precise angular areas with differentiated treatments of the web along these areas;
- the difference in the web linear speed between the web surface in contact with the front conveyor belt 2 and the external surface of the web in the turn is lower the larger the diameter of the internal roller 3*d*: this reduces friction between the external surface of the web and section 5*a* of rear conveyor belt 5, the travelling speed of which is equal to that of front conveyor belt 2 at neck 23;
- the converging section 21 and the diverging section 22 are more progressive the greater the diameter of internal roller 3*d*; and
- the differences of linear speed between conveyor belts 2 and 5 along converging section 21 and along diverging section 22 are lower.

Section 5*a* of rear conveyor belt 5 extends upwards above the converging section 21 so as to shelter in particular the first angular area B1 from aerodynamic turbulence created by movement of storage carriage 10.

As neck 23 has a non-null thickness and can even increase slightly in operation as neck 23 is formed in a zone where section 5*a* is not directly supported on its rear surface, the air pushed back from the web into the converging section and on passing through the neck 23 is limited to the amount strictly necessary and very gradually, hence restricting the tendency to lateral scattering of fibres.

Roller 6*b* which guides rear conveyor belt 5 at the exit of diverging section 22 has a relatively small radius, in particular much smaller than that of internal roller 3*d*. In this way, the rear conveyor belt 5 abruptly moves away from the path of transportation of the web. This promotes a maintained adherence of the web to the front conveyor belt 2 and a break in the adherence of the web to the rear conveyor belt 5. This break occurs in an angular position, around axis 28 of roller 3*d*, which is approximately 45 degrees below the horizontal diametric plane of roller 3*d*. From there, the web travels through a third angular area $B_3$ of the turn, where it is again released from external support to prepare to come to rest on section 5*d*, of rear conveyor belt 5, forming the pinching zone 20.

The geometry of the arrangement of converging section 21—neck 23—diverging section 22 is adjustable by moving the position of roller 6*b* using an adjustment device 24 and along a direction 26 which passes at a distance from the rectilinear segment extending from axis 27 of roller 6*a* to axis 28 of internal roller 3*d*. In other words, the direction 26 does not intersect that segment. In particular, the direction 26 is not radial in relation to roller 3*d*, but on the contrary it is slightly tangential in relation to roller 3*d*. Thus, a fine adjustment is possible, since a variation in the dimension of the neck 23 is obtained by a much greater movement of roller 6*b*.

In the angular area $B_3$, the web faces an opening 29 formed between the sections 5*b* and 5*c* of rear conveyor belt 5. This opening 29 allows escape of any air pushed back from the web at the entry of the pinching zone 20.

Roller 6*d* supporting rear conveyor belt 5 at the entry to the pinching zone is displaced backwards (towards the left in FIG. 5), in relation to the direction of circulation of the web, in relation to point 31 where the front conveyor belt 2 loses contact with internal roller 3*d* to form section 2*d* of pinching zone 20. Turn B therefore has a fourth angular area $B_4$, in which the web comes to rest on the longitudinal section 5*d* of rear conveyor belt 5 to enter gradually the pinching zone 20 by undergoing extremely gradual compression between the flat section 5*d* of rear conveyor belt 5 and the large radius of curvature of front conveyor belt 2 around internal roller 3*d*. In addition, as rollers 3*d* and 6*d* have between them an offset 32, again no rigid pinching line is formed at the entry to the pinching zone 20, since section 5*d* is not directly supported opposite point 31 where section 2*d* and hence the pinching zone 20 begin.

Figure 6:
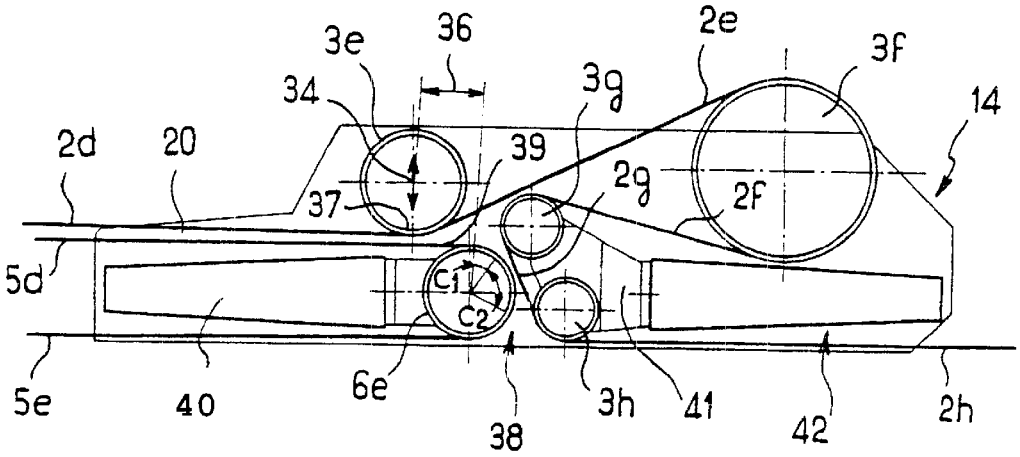
FIG. 6 is a view similar to FIG. 5 but showing the lapping carriage.

The arrow 33 shows that roller 6*d* supporting section 5*d* upstream from the pinching zone 20 is adjustable in height. In addition, a height adjustment shown by arrow 34 on FIG. 6 is provided for the roller 3*e* supporting section 2*d* at the exit of the pinching zone 20. These two adjustments make it possible to adjust the space between sections 2*d* and 5*d* in the pinching zone 20.

In the lapping carriage 14, roller 3*e* supporting section 2*d* at the exit of the pinching zone 20 is displaced backwards by a distance 36 in relation to the travelling direction of the web, in relation to roller 6*e* supporting the corresponding end of section 5*d*. Thus, as at the entry to the pinching zone, formation of a rigid constriction for the web is avoided, section 5*d* not being directly supported at point 37 where conveyor belt 2 begins to go around roller 3*e* and hence where the pinching zone 20 ends.

From roller 3*e*, the conveyor belt 2 forms section 2*e* oriented obliquely upwards. This tends frankly to separate the web from the front conveyor belt 2 before the web begins to be driven into the turn around roller 6*e*.

The end of section 5*d* thus constitutes a preparatory zone 39 for the web, which is in a slight descending slope according to the slope of the pinching zone.

For the turn at approximately 90 degrees in the lapping carriage 14 between the pinching zone 20 and the lapping slot 38, the internal conveyor belt is the rear conveyor belt 5 and the internal roller is the roller 6*e* supporting the rear conveyor belt 5.

The turn around roller 6*e* includes a first angular area $C_1$ without external support of the web and a second angular area $C_2$, which follows the first angular area, and along which the web is externally supported by the planar section 2*g* of front conveyor belt 2. The first angular area $C_1$ covers an angle of the order of 30 to 40 degrees. The second angular area $C_2$ defines with section 2*g* a converging section—neck—diverging section arrangement which is quite similar to that described in detail with reference to FIG. 5 for the storage carriage 10. However, two differences should in particular be noted:

the external surface of section 2*g* is turned obliquely downwards so that the neck of the arrangement is formed above the horizontal diametric plane of internal roller 6*e*; and the diverging section occurs entirely along planar section 2*g*, since roller 3*h* supports the lower end of section 2*g* at a point where the available width between the two conveyor belts is in any case greater than the thickness of the web.

The diameter of roller 3*h* is clearly less than that of roller 6*e*, for example approximately half as large as that of roller 6*e*, as shown in FIG. 6. With this layout, the distance to be covered by the web between the neck of the converging section—neck—diverging section arrangement and the output apron (not shown in this figure) is almost the same along the periphery of the internal roller 6*e* when the lapping carriage 14 moves towards the front part of the machine (towards the right in FIG. 6) as along section 2*g* and the periphery of roller 3*h* when the lapping carriage 14 moves towards the rear of the machine (towards the left in FIG. 6).

The internal roller 6*e* is horizontally adjustable using an adjustment device 40. The rollers 3*g*, 3*h* supporting the external support section 2*g* are supported by a common fitment 41 the position of which is adjustable in a horizontal direction by means of an adjustment device 42.

Figure 7:
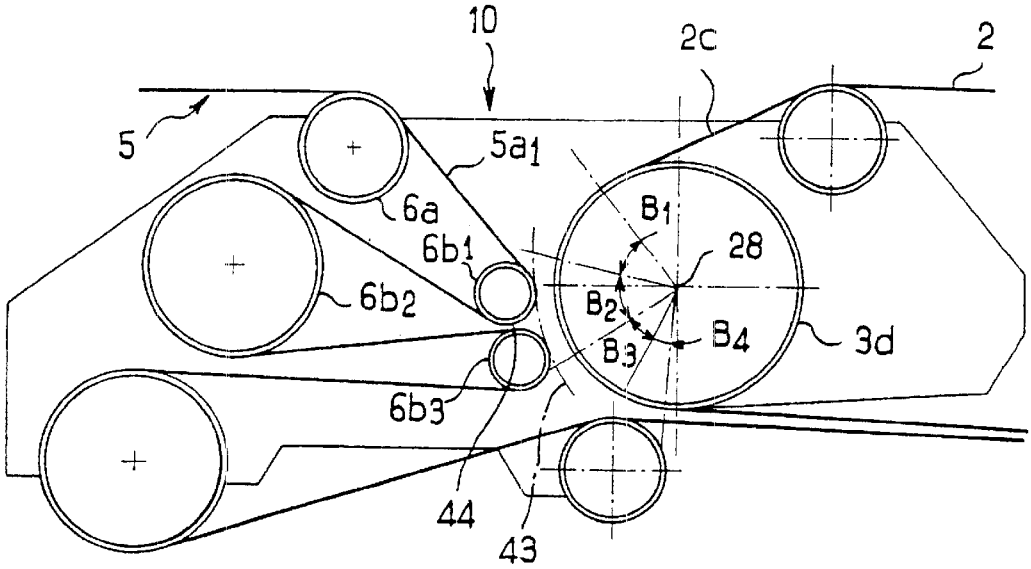
FIG. 7 is a view similar to FIG. 5, but showing a second way of forming the storage carriage.

The embodiment shown in FIG. 7 in relation to the storage carriage 10 will only be described for its differences in relation to that of FIG. 5.

The flat section 5*a* externally supporting the web in its turn in the example of FIG. 5 is replaced by a succession of two rollers $\mathbf{6}_{b1}$, $\mathbf{6}_{b3}$ located at substantially equal distance from axis 28 of internal roller 3*d*. The rollers $\mathbf{6}_{b1}$, $\mathbf{6}_{b3}$ simulate a concave support structure extending according to a line 43 that may be considered as an arc of a circle centred on axis 28 of internal roller 3*d*. Conveyor belt 5 passes over the two rollers $\mathbf{6}_{b1}$, and $\mathbf{6}_{b3}$ on their side adjacent to the web. Line 43 corresponds substantially to the desired trajectory for the external surface of web 4. Between the rollers $\mathbf{6}_{b1}$ and $\mathbf{6}_{b3}$, the rear conveyor belt 5 passes round a detour roller $\mathbf{6}_{b2}$ engaging the external surface of the rear conveyor belt 5. The two areas of rear conveyor belt 5 that respectively pass round roller $\mathbf{6}_{b1}$ and roller $\mathbf{6}_{b3}$ are almost contiguous at the point of maximum proximity 44. Roller $\mathbf{6}_{b3}$ is positioned like roller 6*b* in the example of FIG. 5. Roller $\mathbf{6}_{b1}$ is situated upstream of roller $\mathbf{6}_{b3}$ in relation to the travelling direction of the web, and has the same diameter as roller $\mathbf{6}_{b3}$. Upstream of roller $\mathbf{6}_{b1}$, in relation to the travelling direction of the rear conveyor belt 5, the rear conveyor belt 5 forms a flat section $\mathbf{5}_{a1}$ which in service is practically not in contact with the web and the essential function of which is therefore to shelter the web resting on the preparatory section 2*c* and on front conveyor belt 2 in the first angular area $B_1$ from aerodynamic turbulence.

Figure 8:
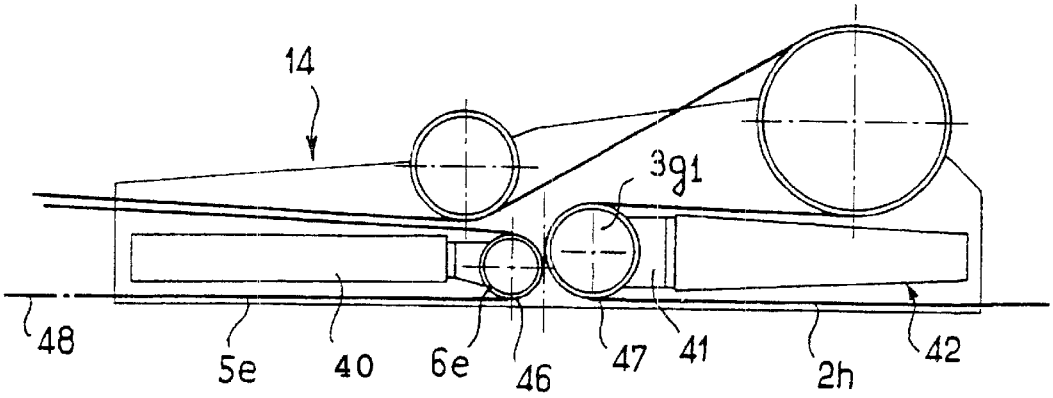
FIG. 8 is a view similar to FIG. 6, but showing a second way of forming the lapping carriage.

In the example of FIG. 8, which will only be described for its differences in relation to that of FIG. 6, the lapping carriage 14 includes, in place of the external support set formed by the two rollers 3*g*, 3*h* and the front conveyor belt section 2*g*, a single roller 3*g*1 with a larger diameter than the internal roller 6*e*. These rollers 6*e* and $\mathbf{3}g_1$ have their lower generating lines 46, 47 on the same horizontal level 48 in which sections 5*e* of rear conveyor belt 5 and 2*h* of front conveyor belt 2 also extend, at a short distance above the output apron 8 not shown in FIG. 8. Thus, the neck formed between conveyor belts 2 and 5 in the area where rollers 6*e* and $\mathbf{3}g_1$ are closest together is, as in the example of FIG. 6, situated above the horizontal diametric plane of roller 6*e*.

The embodiments of FIGS. 5 and 6 are preferred to those of FIGS. 7 and 8 respectively since in the former the web is never compressed in rigid necks and is always kept in converging section—neck—diverging section configurations which present considerable progressiveness. This improves the effect of carrying along and assisting drive of the web by its external surface at the turn, whilst reducing the harmful effects of cycles of compression/decompression. Moreover, the embodiment of FIG. 8 does not, contrary to that for FIG. 6, fulfil the desirable condition of equality of distance to be covered by the web between the neck and contact with the output apron for the two directions of movement of carriage 14. This path is longer along roller 3*g*, than along roller 6*e* having a smaller diameter.

Of course, the invention is not limited to the examples described and shown.

In the example of FIG. 5, roller 6*a* could be placed in a higher position, somewhat as shown in FIG. 7, in order better to protect from aerodynamic turbulence the web resting on the preparatory section 2*c* of the front conveyor belt 2.

In the example of FIG. 7, section $\mathbf{5}_{a1}$ could be made more vertical so that it would form a sort of converging section up to the double neck formed by rear conveyor belt 5 on each of the rollers $\mathbf{6}_{b1}$ and $\mathbf{6}_{b3}$.

The limits between the angular areas B1, B2, B3, B4 and C1, C2, of the same turn are approximate and they depend in particular on the thickness of the web, the adjustments made for positioning the adjustable rollers such as 6*b*, 3*g*, 3*h*, 6*e*, 3*g*1, etc.

Rollers other than 3*i* and 6*j* could be chosen as driving rollers. For front conveyor belt 2, roller 3*a* could for example be motorised at a peripheral speed corresponding to that of the card output.

What is claimed is:

1. A crosslapper comprising:

at least two endless conveyor belts which together define, for a web of fibers, a transportation path extending between an entry zone and a lapping slot;

at least one lapping carriage bearing rollers for guiding the two conveyor belts and on which the lapping slot is formed; and an output apron which is movable beneath the lapping slot and along a direction which is substantially parallel to the axes of the guide rollers, the transportation path forming at least one turn against the external surface of one of the conveyor belts in a zone where the internal surface of said one conveyor belt rests on an internal guide roller, the web being exposed in a first angular area of the turn, then being limited radially outwards by a support zone belonging to the other conveyor belt in a second angular area of the turn, wherein with respect to the web path along said turn, said one conveyor belt is a radially internal conveyor belt and said other conveyor belt is a radially external conveyor belt, and wherein the support zone is guided according to a curvature ranging from convex with a radius greater than the internal guide roller, to concave substantially matching the external circumference of the web.

2. A crosslapper according to claim 1, characterised in that the support zone (5*a*, 2*g*) is substantially flat.

3. A crosslapper according to claim 2, characterised in that the support zone is formed by a section (5*a*, 2*g*) of the external conveyor belt tensioned between two external rollers (6*a*, 6*b*; 3*g*, 3*h*) which are angularly positioned around the internal roller, one upstream and one downstream from a neck (23) formed between the two conveyor belts in the second angular area (B2, C2).

4. A crosslapper according to claim 3, characterised in that at least one of the two external rollers (6*b*, 3*g*, 3*h*) is adjustable so as to adjust the clearance between the two conveyor belts in the second angular area (B2, C2).

5. A crosslapper according to claim 4, characterised in that said at least one external roller (6*b*) is adjustable along a direction (26) which passes at a distance from the segment extending from the axis (28) of the internal roller (3*d*) to the axis (27) of the other external roller (6*a*).

6. A crosslapper according to claim 1, characterised in that in the second angular area (B2; C2) of the turn, the two conveyor belts together form a converging section (21) followed by a diverging section (22), relative to the direction of transportation of fibres.

7. A crosslapper according to claim 6, characterised in that the converging section (21) and the diverging section (22) are connected by a neck (23) where the two conveyor belts (2, 5) are spaced apart from each other even at rest in the absence of web.

8. A crosslapper according to claim 6, wherein along the converging section—neck—diverging section configuration, the external conveyor belt is guided around an external guide roller of greater diameter than the internal guide roller, and wherein lower generating lines of the internal and external guide rollers are on a same horizontal plane.

9. A crosslapper according to claim 6, characterised in that:

the turn forms an angle (B) included between 90 and 180° up to a longitudinal zone (20) of the transportation path; and the external surface of the external conveyor belt faces obliquely upwards in the neck zone (23), so as to support the web from below in the neck zone.

10. A crosslapper according to claim 1, wherein the support zone is made with a concave shape by a sequence of two convex zones of a smaller radius than the internal guide roller and which follow one another along the periphery of the internal guide roller with a certain radial interval between each convex zone and the external surface of the internal conveyor belt.

11. A crosslapper according to claim 1, characterised in that the first angular area (B1; C1) is preceded by a section with an oblique slope (2*c*, 39) where, in service, the web rests exposed on the upwardly facing external surface of the internal conveyor belt.

12. A crosslapper according to claim 1, characterised in that the turn is formed in the lapping carriage (14) and deflects the web from a longitudinal orientation upstream of the lapping carriage (14) to an orientation downwards in the lapping slot (38).

13. A crosslapper according to claim 12, characterised in that the external surface of the external conveyer belt (2*g*) is turned obliquely downwards in the neck zone.

14. A crosslapper according to claim 12, characterised in that said zone where the web is covered by the external conveyor belt is a pinching zone (20) extending substantially along a straight line from a storage carriage (10).

15. A crosslapper according to claim 14, characterised in that the web is transported exposed from the entry zone (2*a*) to a storage carriage (10).

16. A crosslapper according to claim 14, wherein the pinching zone slightly slants downwardly, in relation to the fibers transportation direction.

17. A crosslapper according claim 1, characterised in that the first angular area (C1) is preceded by a preparatory zone (39) where the web rests exposed on the internal conveyor belt and, immediately upstream, by a zone (20) where the web (4) is covered by the external conveyor belt, which moves away from the web obliquely upwards in the preparatory zone.

18. A crosslapper according to claim 1, characterised in that the first angular area (B1) is preceded by a section with an oblique slope (2*c*) where, in service, the web rests exposed on the upwardly facing external surface of the internal conveyor belt, and in that the oblique section is substantially perpendicular to a section (5*a*) of the external section in the neck zone (23).

19. A crosslapper according to claim 1, characterised in that the turn is made on a storage carriage (10) placed at the entry of a web pinching zone (20) between the two conveyor belts (2, 5), the pinching zone extending substantially up to the lapping carriage (14).

20. A crosslapper according to claim 19, characterised in that the external conveyor belt is out of contact with the web in the whole path of the web in the crosslapper upstream of the second angular area (B2) of the turn in the storage carriage (10).

21. A crosslapper according to claim 1, characterised in that the diameter of the internal roller (3*d*) is at least of the order of 20 cm.

22. A crosslapper according to claim 1, characterised in that the web is released on its radially external side in a third angular area (B3) of the turn, above a longitudinal section (5*d*) of the external conveyor belt passing under the internal roller (3*d*) while forming a certain interval with the external surface of the internal conveyor belt.

23. A crosslapper according to claim 22, characterised in that the longitudinal section (5*d*) of the external conveyor belt is supported by a height-adjustable roller (6*d*) which is rearwardly offset in relation to the internal roller (3*d*) relative to the direction of movement of the web.

24. A crosslapper according to claim 22, characterised in that the external conveyor belt defines an opening (29) facing the third angular area (B3).

25. A crosslapper according to claim 22, characterised in that the longitudinal section (5*d*) of the external conveyor belt forms with a longitudinal section (2*d*) of the internal conveyor belt downstream of the internal roller (3*d*) a slightly descending section of the pinching zone (20) in relation to the horizontal.

26. A crosslapper according to claim 25, characterised in that the slightly descending section extends in a rectilinear way to the lapping carriage (14).

27. A crosslapper according to claim 1, wherein the transport path includes:

an exposed transportation path between the entry zone and a storage carriage, a path where the web is supported exposed on a front conveyor belt forming part of said at least two endless conveyor belts, a first turn made on the storage carriage between the exposed transportation path and a pinching-zone extending substantially in a straight line from the storage carriage to the lapping carriage between said front conveyor belt and a rear conveyor belt also forming part of said at least two conveyor belts, a second turn of 90° made on the lapping carriage between the pinching zone and the lapping slot, and wherein said at least one turn where the support zone is guided according to said curvature includes said first and second turns, the front conveyor belt forming the internal conveyor belt in the first turn and forming the external conveyor belt defining the support zone in the second turn, the rear conveyor belt forming the internal conveyor belt in the second turn and forming the external conveyor belt defining the support zone in the first turn.

* * * * *